US009218926B1

(12) United States Patent
Pierce

(10) Patent No.: US 9,218,926 B1
(45) Date of Patent: Dec. 22, 2015

(54) NORMALLY-CLOSED SWITCH WITH POSITIVE STOPS

(71) Applicant: E.M.B. Corporation, Elizabethtown, KY (US)

(72) Inventor: Anthony E. Pierce, Elizabethtown, KY (US)

(73) Assignee: E.M.B. Corporation, Elizabethtown, KY (US)

( * ) Notice: Subject to any disclaimer, the term of this patent is extended or adjusted under 35 U.S.C. 154(b) by 116 days.

(21) Appl. No.: 14/185,625

(22) Filed: Feb. 20, 2014

Related U.S. Application Data

(60) Provisional application No. 61/787,830, filed on Mar. 15, 2013.

(51) Int. Cl.

| | |
|---|---|
| ***H01H 1/30*** | (2006.01) |
| ***H01H 13/52*** | (2006.01) |
| ***H01H 1/26*** | (2006.01) |
| ***H01H 3/12*** | (2006.01) |

(52) U.S. Cl.
CPC ..... *H01H 13/52* (2013.01); *H01H 1/26* (2013.01); *H01H 1/30* (2013.01); *H01H 3/12* (2013.01); *H01H 2001/265* (2013.01)

(58) Field of Classification Search
CPC . H01H 13/52; H01H 1/245; H01H 2001/247; H01H 3/04; H01H 3/46; H01H 3/12; H01H 3/122; H01H 1/30; H01H 1/26; H01H 2001/265
USPC ..... 200/535, 245–247
See application file for complete search history.

(56) References Cited

U.S. PATENT DOCUMENTS

| | | | | |
|---|---|---|---|---|
| 2,958,752 | A * | 11/1960 | Horman | 200/535 |
| 3,185,803 | A * | 5/1965 | Driscoll | 200/535 |
| 3,906,417 | A * | 9/1975 | Serras-Paulet | 335/205 |
| 3,944,760 | A * | 3/1976 | Zdanys et al. | 200/6 BB |
| 4,063,054 | A * | 12/1977 | Hirata | 200/1 B |
| 4,177,367 | A * | 12/1979 | Tirone et al. | 200/535 |
| 4,616,117 | A * | 10/1986 | Kleine | 200/243 |
| 4,902,863 | A * | 2/1990 | Fukuma | 200/445 |
| 5,145,057 | A * | 9/1992 | Hirota et al. | 200/243 |
| 6,281,482 | B1 * | 8/2001 | Chu | 219/507 |
| 7,030,325 | B2 * | 4/2006 | Blossfeld et al. | 200/11 R |
| 8,766,126 | B2 * | 7/2014 | Kawaguchi et al. | 200/535 |

OTHER PUBLICATIONS

EMB Corporation, "600 Series Non Snap Action Switch", 2011 Product Catalog.

* cited by examiner

*Primary Examiner* — Felix O Figueroa
(74) *Attorney, Agent, or Firm* — Stites & Harbison, PLLC; David W. Nagle, Jr.

(57) ABSTRACT

A normally-closed switch comprises: a housing; a push button that is mounted for movement with respect to the housing; a stationary terminal; a moveable terminal that, when in contact with the stationary terminal, completes a circuit; and one or more positive stops that engage the stationary terminal. When a force is applied to the push button, the moveable terminal breaks contact with the stationary terminal, thus opening the circuit. The one or more positive stops apply pressure to and maintain a predetermined position of the stationary terminal, but do not interfere with or impede the moveable terminal.

14 Claims, 7 Drawing Sheets

NORMALLY-CLOSED SWITCH WITH POSITIVE STOPS

CROSS-REFERENCE TO RELATED APPLICATIONS

The present application claims priority to U.S. Provisional Patent Application Ser. No. 61/787,830 filed on Mar. 15, 2013, the entire disclosure of which is incorporated herein by reference.

BACKGROUND OF THE INVENTION

Many refrigerators and freezers have an interior light that is off when the door is closed, but is on when the door is opened. To turn such a light on or off in response to the movement of the door, a normally-closed switch is commonly installed near the door of the refrigerator or freezer. Such a normally-closed switch has a push button that is biased into an extended position. When the push button is in this extended position (i.e., when the door is open), a moveable terminal is in contact with a stationary terminal, completing a circuit that energizes the interior light. As the door is closed, the push button is engaged by the door and rotates into the housing of the switch. Such rotation of the push button causes an internal post member to move downward and apply pressure to the moveable terminal, causing the moveable terminal to break contact with the stationary terminal, thus opening the circuit.

One problem that commonly occurs with such normally-closed switches is that, in some cases, the circuit never opens, and the interior light is always on. For instance, improper installation of the switch can lead to this problem, especially when there is a lack of quality control by the manufacturer with respect to ensuring the correct gap between the liner and the door relative to the switch location. Further compounding this problem, when the internal post member moves downward and causes the moveable terminal to break contact with the stationary terminal, it has also been observed that there is often some slight movement of the stationary terminal. In other words, the stationary terminal may move with the moveable terminal to some extent, resisting the disengagement of the moveable terminal from the stationary terminal.

Thus, there remains a need for an improved construction for such a normally-closed switch that better ensures that the circuit is opened (and the interior light off) when the door is closed.

SUMMARY OF THE INVENTION

The present invention is a normally-closed switch with positive stops.

A normally-closed switch made in accordance with the present invention includes a housing that defines an internal cavity in which the internal components of the switch are housed, and the switch further includes a push button that is mounted for movement with respect to the housing. When the push button is in an extended position, a moveable terminal is in contact with a stationary terminal, completing a circuit. However, when a force is applied to the push button, the push button rotates into the housing about a pivot axis. Such rotation of the push button forces an internal post member, which extends between the push button and the moveable terminal, to move downward. As it moves downward, the distal end of the internal post member engages and applies pressure to the moveable terminal, causing the moveable terminal to break contact with the stationary terminal, thus opening the circuit. Once the force is no longer applied to the push button, the push button returns to the extended position. In this regard, the moveable terminal has sufficient resilience that it also functions like a leaf spring, providing a biasing force against the internal post member that returns the push button to the extended position.

The normally-closed switch further includes one or more positive stops engaging the stationary terminal at a predetermined position in the movement of the stationary terminal. Thus, the stationary terminal is prevented, at a given point, from any further movement with the moveable terminal, at least beyond the predetermined position. In other words, the positive stops substantially eliminate any resistance to the disengagement of the moveable terminal from the stationary terminal. And, as a result, the normally-closed circuit opens and closes more consistently.

DETAILED DESCRIPTION OF THE INVENTION

The present invention is a normally-closed switch with positive stops.

Figure 1:
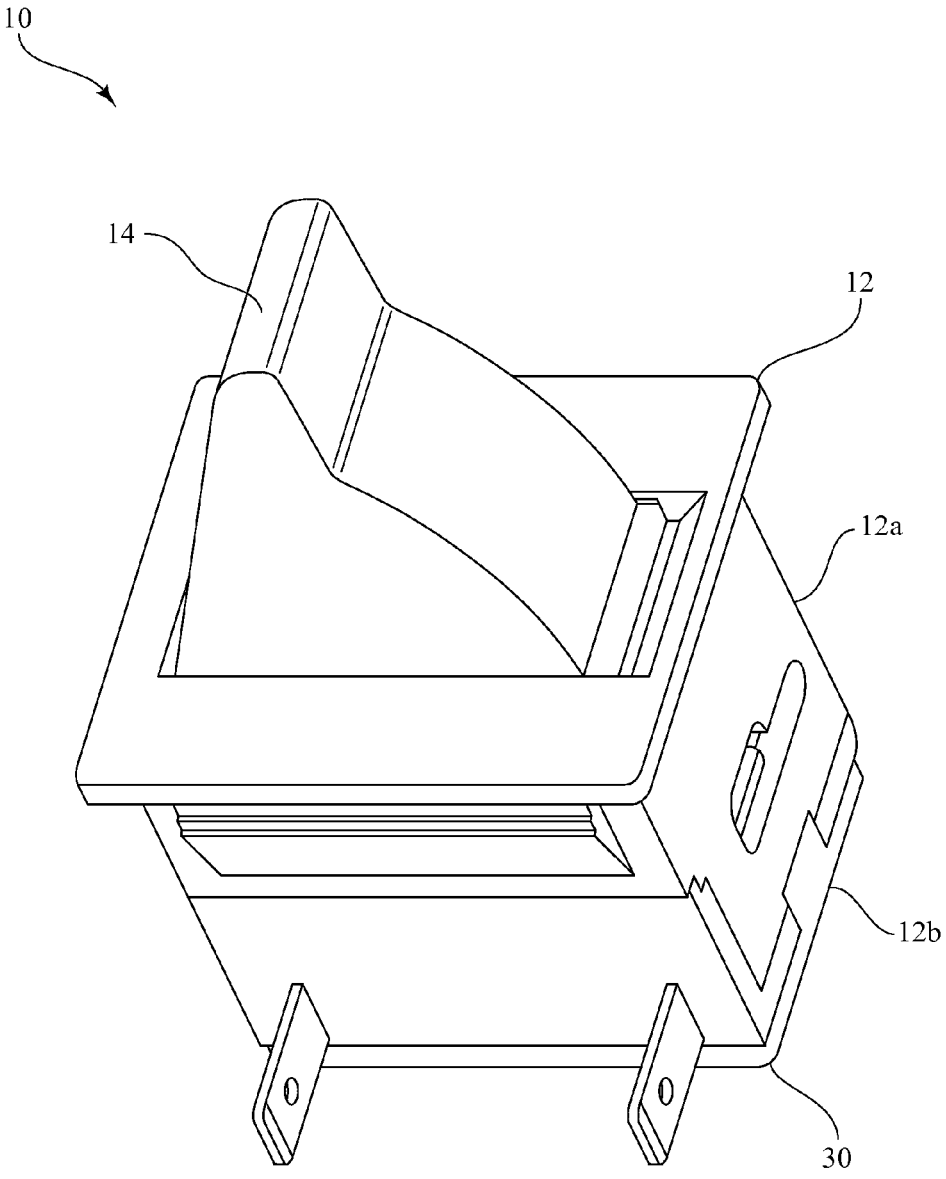
FIG. 1 is a perspective view of an exemplary normally-closed switch made in accordance with the present invention.
Figure 2:
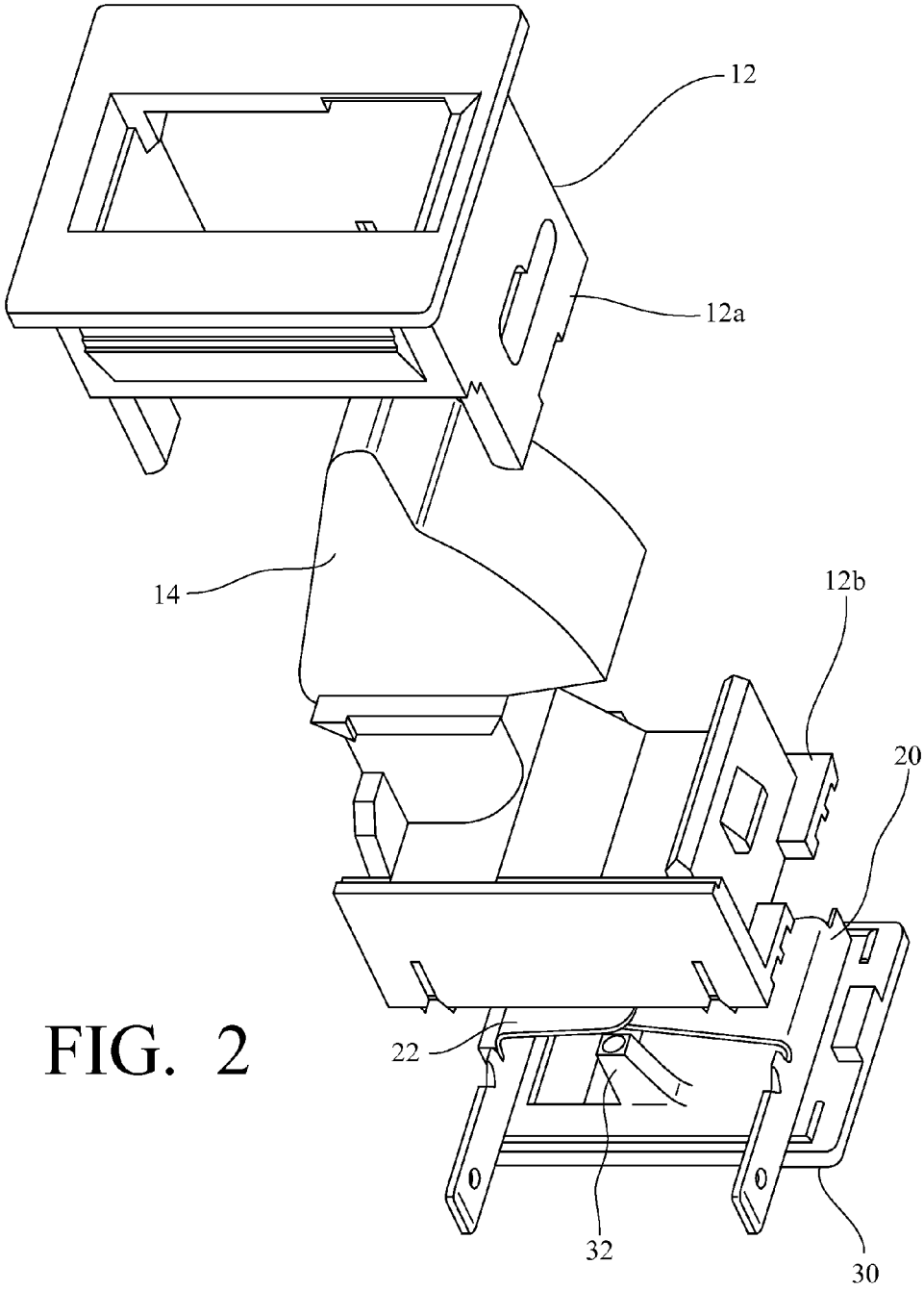
FIG. 2 is an exploded perspective view of the exemplary normally-closed switch of FIG. 1.
Figure 3:
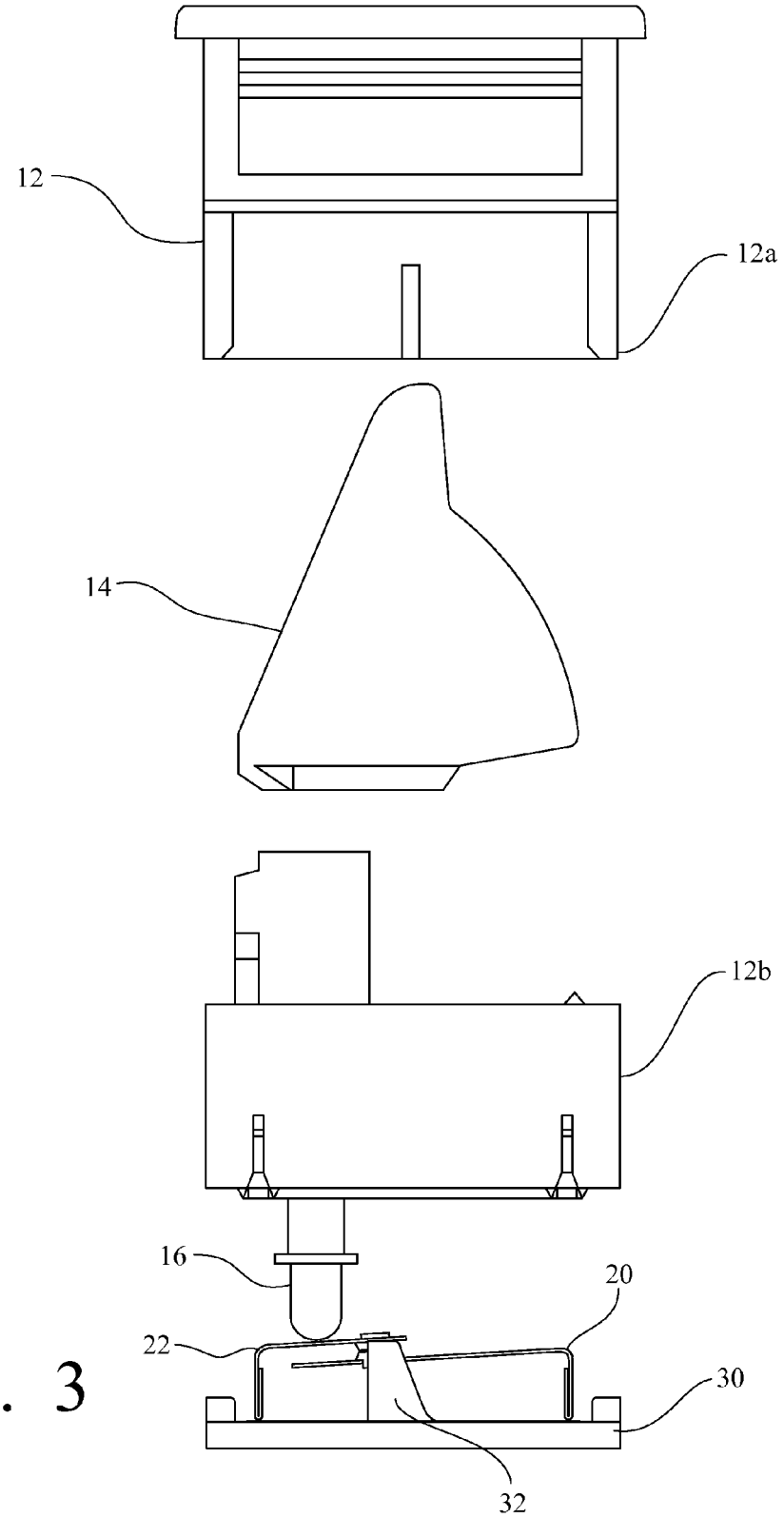
FIG. 3 is an exploded side view of the exemplary normally-closed switch of FIG. 1.
Figure 4:
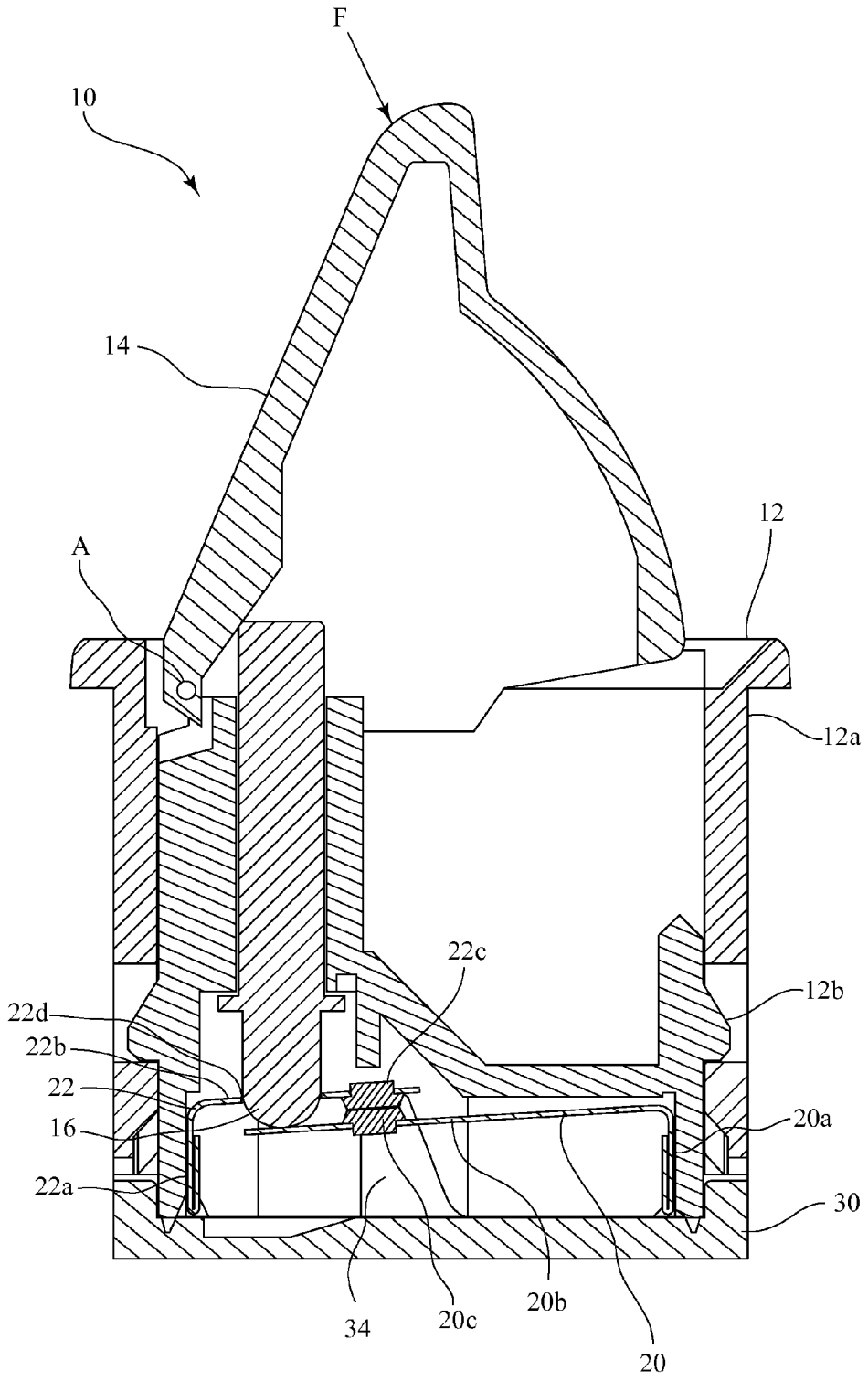
FIG. 4 is a side sectional view of the exemplary normally-closed switch of FIG. 1.
Figure 5:
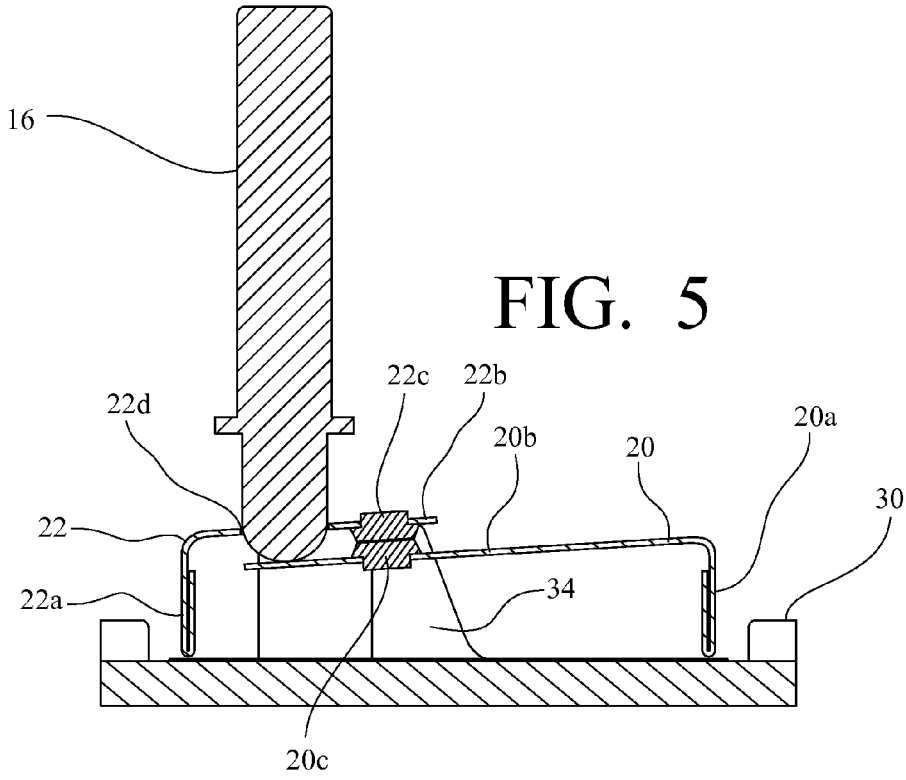
FIG. 5 is a partial side sectional view of the exemplary normally-closed switch of FIG. 1, wherein the switch is in a closed position.

FIGS. 1-8 are various views of an exemplary normally-closed switch 10 made in accordance with the present invention. As perhaps best shown in the sectional view of FIG. 4, the switch 10 includes a housing 12 that defines an internal cavity in which the internal components of the switch 10 are housed. In this exemplary embodiment, and as shown in FIGS. 1-4, the housing 12 is actually comprised of two separate portions 12*a*, 12*b* that are assembled together. As also best shown in the sectional view of FIG. 4, the switch 10 further includes a push button 14 that is mounted for movement with respect to the housing 12. When the push button 14 is in an extended position, a moveable terminal 20 is in contact with a stationary terminal 22 (as also shown in FIGS. 1 and 5), completing a circuit. However, when a force is applied to the push button 14 (as indicated by arrow F in FIG. 4), the push button 14 rotates into the housing 12 about a pivot axis A. Such rotation of the push button 14 forces an internal post member 16, which extends between the push button 14 and the moveable terminal 20, to move downward and apply pressure to the moveable terminal 20.

In this exemplary embodiment, the moveable terminal 20 is a unitary component made from a conductive material, such as copper. However, the moveable terminal 20 can be characterized as including a first portion 20*a* that is rigidly secured within the internal cavity defined by the housing 12 and serves as a blade connector, along with a second portion 20*b* that extends from the first portion 20*a* in a cantilever arrangement. In other words, the second portion 20*b* is effectively a cantilever that is anchored to the first portion 20*a*. When a sufficient force is applied to the distal end of the second portion 20*b* of the moveable terminal 20, it will deflect and rotate downward relative to the first portion 20*a* of the moveable terminal 20 about an axis defined by the interface between the first portion 20*a* and the second portion 20*b*. Finally, with respect to the moveable terminal 20, in this exemplary embodiment, and as shown in FIG. 4, the moveable terminal 20 includes an enlarged contact portion 20*c* on the upper surface of the second portion 20*b*.

In this exemplary embodiment, the stationary terminal 22 is also a unitary component made from a conductive material, such as copper. The stationary terminal 22 can also be characterized as including a first portion 22*a* that is rigidly secured within the internal cavity defined by the housing 12 and serves as a blade connector, along with a second portion 22*b* that extends from the first portion 22*a*. Furthermore, similar to the moveable terminal 20, in this exemplary embodiment, and as shown in FIG. 4, the stationary terminal 22 includes an enlarged contact portion 22*c* on the bottom surface of the second portion 22*b*. Finally, an opening 22*d* is defined by the stationary terminal 22, as perhaps best shown in the bottom view of FIG. 8, which allows the internal post member 16 to move downward and through the stationary terminal 22, so that it can engage and apply pressure to the moveable terminal 20, but without contacting the stationary terminal 22.

Figure 6:
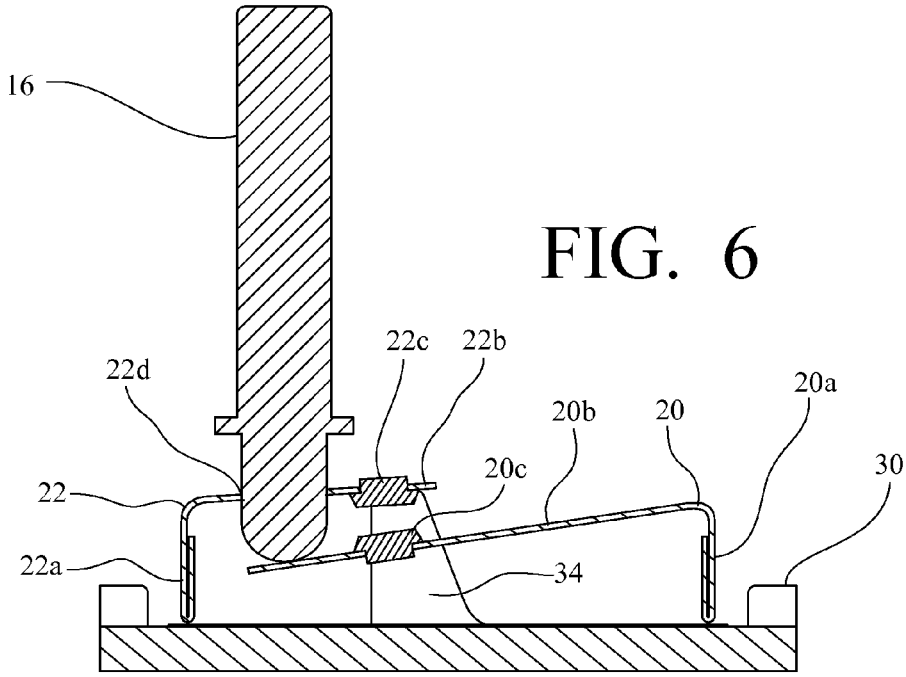
FIG. 6 is a partial side sectional view of the exemplary normally-closed switch of FIG. 1, wherein the switch is in an open position.

Referring still to the sectional view of FIG. 4, when the distal end of the internal post member 16 applies pressure to the moveable terminal 20, it causes the moveable terminal 20 to break contact with the stationary terminal 22, thus opening the circuit (as shown in FIG. 6). Once the force is no longer applied to the push button 14, the push button 14 returns to the extended position. In this regard, the moveable terminal 20 has sufficient resilience that it also functions like a leaf spring, providing a biasing force against the internal post member 16 that returns the push button 14 to the extended position.

Furthermore, the exemplary normally-closed switch 10 includes a cover 30 that closes access to the internal cavity defined by the housing 12 of the switch 10 near the terminals 20, 22. A pair of positive stops 32, 34 extends from the surface of this cover 30, with each of the stops 32, 34 engaging the second portion 22*b* of the stationary terminal 22 at a predetermined position in the movement of the stationary terminal 22, in order to provide a more consistent operation.

Figure 7:
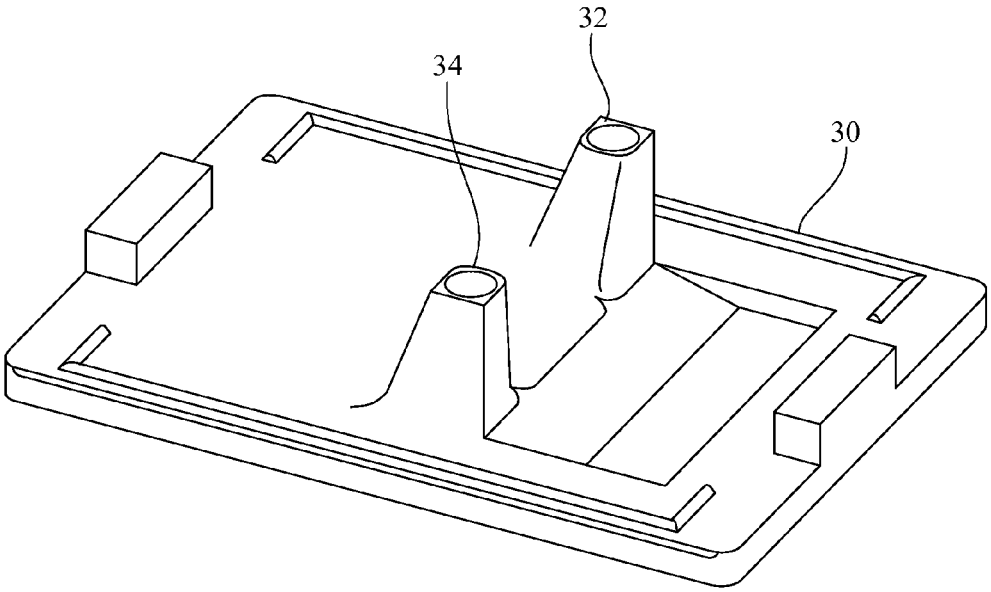
FIG. 7 is a perspective view of the cover of the exemplary normally-closed switch of FIG. 1.
Figure 8:
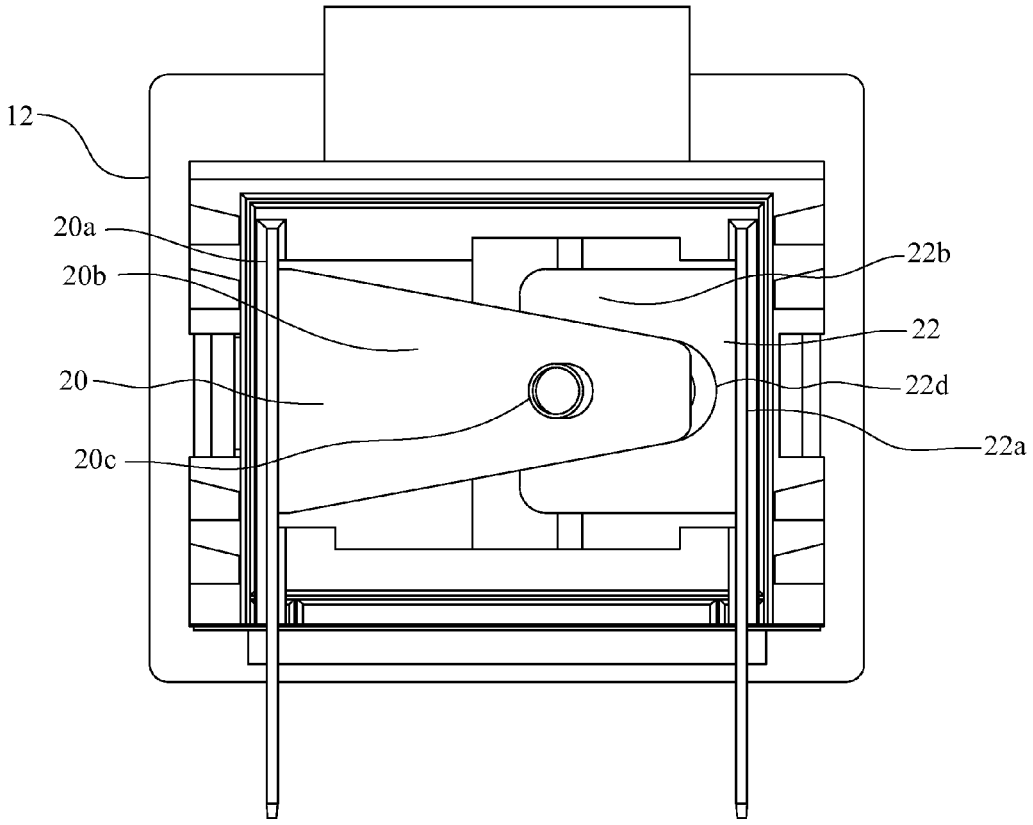
FIG. 8 is a bottom view of the exemplary normally-closed switch of FIG. 1, but with the cover removed to better show the stationary terminal and the moveable terminal.

For further explanation of the function of the stops 32, 34, reference is now made to FIGS. 5-8. FIG. 5 is a partial side sectional view of the switch 10 in a closed position, while FIG. 6 is a partial side sectional view of the switch 10 in an open position. FIG. 7 is a perspective view of the cover 30 of the switch 10, while FIG. 8 is a bottom view of the switch 10, but with the cover 30 removed to better show the stationary terminal 22 and the moveable terminal 20.

As shown in FIGS. 5-8, the stops 32, 34 have no effect on the movement of the moveable terminal 20. In this regard, the second portion 20*b* of the moveable terminal 20 preferably has a tapered (triangular) shape, such that it can move relative to and between the stops 32, 34 without contacting the stops 32, 34. Accordingly, in use, the stops 32, 34 apply pressure to and maintain the position of stationary terminal 22, but do not interfere with or impede the moveable terminal 20. When the internal post member 16 moves downward and applies pressure to the moveable terminal 20, the stationary terminal 22 is prevented from any further movement with the moveable terminal 20, at least beyond a predetermined position. In other words, the positive stops 32, 34 substantially eliminate any resistance to the disengagement of the moveable terminal 20 from the stationary terminal 22. And, as a result, the normally-closed circuit opens and closes more consistently.

One of ordinary skill in the art will also recognize that additional embodiments are also possible without departing from the teachings of the present invention. This detailed description, and particularly the specific details of the exemplary embodiment disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A normally-closed switch, comprising:

a housing that defines an internal cavity;

a push button that is mounted for movement with respect to the housing;

a stationary terminal;

a moveable terminal that, when in contact with the stationary terminal, completes a circuit;

an internal post member that extends between the push button and the moveable terminal, wherein an opening is defined by and through the stationary terminal, and the internal post member passes through the opening defined by and through the stationary terminal to engage the moveable terminal; and one or more positive stops that engage the stationary terminal;

wherein, when a force is applied to the push button, the push button rotates and forces the internal post member to move downward and apply pressure to the moveable terminal, causing the moveable terminal to break contact with the stationary terminal, thus opening the circuit; and wherein, the one or more positive stops apply pressure to and maintain a predetermined position of the stationary terminal, but do not interfere with or impede the moveable terminal.

2. The normally-closed switch as recited in claim 1, wherein the moveable terminal has sufficient resilience to provide a biasing force against the internal post member that returns the push button to an extended position.

3. The normally-closed switch as recited in claim 1, wherein the moveable terminal includes a first portion that is rigidly secured within the internal cavity defined by the housing and serves as a blade connector, and a second portion that extends from the first portion in a cantilever arrangement, such that, when the force is applied to the push button, the internal post member engages and applies pressure to a distal end of the second portion of the moveable terminal, causing the moveable terminal to deflect and rotate downward relative to the first portion of the moveable terminal and thus break contact with the stationary terminal.

4. The normally-closed switch as recited in claim 1, wherein at least one positive stop is positioned on one side of the moveable terminal, and at least one positive stop is positioned on an opposite side of the moveable terminal.

5. A normally-closed switch, comprising:

a housing that defines an internal cavity;

a push button that is mounted for movement with respect to the housing;

a stationary terminal;

a moveable terminal that, when in contact with the stationary terminal, completes a circuit;

an internal post member that extends between the push button and the moveable terminal, wherein an opening is defined by and through the stationary terminal, and the internal post member passes through the opening defined by and through the stationary terminal to engage the moveable terminal;

a cover that closes access to the internal cavity defined by the housing;

one or more positive stops extending from the cover and engaging the stationary terminal;

wherein, when a force is applied to the push button, the push button rotates and forces the internal post member to move downward and apply pressure to the moveable terminal, causing the moveable terminal to break contact with the stationary terminal, thus opening the circuit; and wherein, the one or more positive stops extending from the cover apply pressure to and maintain a predetermined position of the stationary terminal, but do not interfere with or impede the moveable terminal.

6. The normally-closed switch as recited in claim 5, wherein the moveable terminal has sufficient resilience to provide a biasing force against the internal post member that returns the push button to an extended position.

7. The normally-closed switch as recited in claim 5, wherein at least one positive stop extends from the cover on one side of the moveable terminal, and at least one positive stop extends from the cover on an opposite side of the moveable terminal.

8. A normally-closed switch, comprising:

a housing that defines an internal cavity;

a push button that is mounted for movement with respect to the housing;

a stationary terminal, including a first portion that is rigidly secured within the internal cavity defined by the housing and serves as a blade connector, along with a second portion that extends from the first portion;

a moveable terminal, including a first portion that is rigidly secured within the internal cavity defined by the housing and serves as a blade connector, along with a second portion that extends from the first portion in a cantilever arrangement, wherein, when in contact with the stationary terminal, said moveable terminal completes a circuit;

an internal post member that extends between the push button and a distal end of the second portion of the moveable terminal; and one or more positive stops that engage the second portion of the stationary terminal;

wherein an opening is defined by and through the second portion of the stationary terminal, and the internal post member passes through the opening defined by and through the second portion of the stationary terminal to engage the second portion of the moveable terminal;

wherein, when a force is applied to the push button, the push button rotates and forces the internal post member to move downward and apply pressure to the distal end of the second portion of the moveable terminal, causing the moveable terminal to deflect and rotate downward relative to the first portion of the moveable terminal and break contact with the stationary terminal, thus opening the circuit; and wherein, the one or more positive stops apply pressure to and maintain a predetermined position of the second portion of the stationary terminal, but do not interfere with or impede the moveable terminal.

9. The normally-closed switch as recited in claim 8, wherein the second portion of the moveable terminal has sufficient resilience to provide a biasing force against the internal post member that returns the push button to an extended position.

10. The normally-closed switch as recited in claim 8, and further comprising a cover that closes access to the internal cavity defined by the housing, and wherein the one or more positive stops extend from the cover and engage the second portion of the stationary terminal.

11. The normally-closed switch as recited in claim 8, wherein at least one positive stop is positioned on one side of the second portion of the moveable terminal, and at least one positive stop is positioned on an opposite side of the second portion of the moveable terminal.

12. The normally-closed switch as recited in claim 10, wherein at least one positive stop extends from the cover on one side of the second portion of the moveable terminal, and at least one positive stop extends from the cover on an opposite side of the second portion of the moveable terminal.

13. The normally-closed switch as recited in claim 11, wherein the second portion of the moveable terminal has a tapered shape, such that it can move relative to and between the positive stops without contacting the positive stops.

14. The normally-closed switch as recited in claim 12, wherein the second portion of the moveable terminal has a tapered shape, such that it can move relative to and between the positive stops without contacting the positive stops.

* * * * *